US005344066A

United States Patent [19]

Fogle

[11] Patent Number: 5,344,066

[45] Date of Patent: Sep. 6, 1994

[54] CARTON WITH RECLOSABLE CORNER POUR OPENINGS

[75] Inventor: James C. Fogle, Marietta, Ga.

[73] Assignee: Riverwood International Corporation, Atlanta, Ga.

[21] Appl. No.: 128,945

[22] Filed: Sep. 29, 1993

[51] Int. Cl.[5] ..... B65D 5/70

[52] U.S. Cl. ..... 229/231; 220/416; 229/215; 229/239

[58] Field of Search ..... 220/416; 229/214, 215, 229/217–219, 229, 231, 239

[56] References Cited

U.S. PATENT DOCUMENTS

| | | | |
|---|---|---|---|
| 2,403,138 | 7/1946 | Sullivan | 229/218 |
| 2,773,634 | 12/1956 | Negoro | 229/218 |
| 2,974,846 | 3/1961 | Struble | 229/231 |
| 3,048,324 | 8/1962 | Anderson | 229/231 |
| 3,134,531 | 5/1964 | Hardy, Jr. | 229/218 |
| 3,302,847 | 2/1967 | Hennessey | 229/231 |
| 3,616,987 | 11/1971 | Krzyzanowski | 229/231 |
| 3,952,940 | 4/1976 | Malcolm | 229/231 |
| 4,513,863 | 4/1985 | Schillinger | 229/231 |
| 4,913,292 | 4/1990 | Field | 229/231 |

FOREIGN PATENT DOCUMENTS

| | | | |
|---|---|---|---|
| 4037420 | 4/1992 | Fed. Rep. of Germany | 229/231 |

*Primary Examiner*—Gary E. Elkins

[57] ABSTRACT

A carton constructed to permit the contents to be poured out over an upper corner. The top panel includes a fold line about which a corner closure flap pivots. The corner flap includes a flange formed by tear lines in portions of the adjacent side and end panels. Additional layers of material in face-to-face contact with the inner surface of the side and end panels in the area of the closure flap provide edges over which the contents are poured. The closure flap fits tightly over the additional layers to hold it in place after it has been reclosed.

2 Claims, 3 Drawing Sheets

48
92
78
76
86
82
20
28
88
24
12
62
64
52
72
74
14
68
66
50
80
18
22
84
26
45
40
46
32
36
38
34
70
90
44
42
60
58
54
56

92'
98
20'
96
18'

CARTON WITH RECLOSABLE CORNER POUR OPENINGS

FIELD OF THE INVENTION

This invention relates to cartons for packaging pourable material. More particularly, it relates to cartons of this type which contain closable pouring openings.

BACKGROUND OF THE INVENTION

It is well known to package dry particulate material in boxes or cartons from which it can be poured. Cereal, for example, is conventionally packaged in rectangular boxes having a top panel formed from overlapping flaps connected to the side panels and underlying glue flaps connected to the end panels. The package is opened by separating the outer top panel flap from the inner top panel flap, and is closed by inserting an end tab on the outer flap into a locking slot in the inner flap. The slot is initially hidden from view by the overlapping flap and is exposed upon separating the two flaps. A common complaint against this package design is the difficulty in separating the flaps. The glue adhering the overlapping flaps to each other and to the underlying short glue flaps is often so strong or so liberally applied that the outer flap tears instead of separating along the glue line. If the tab is completely torn off, the top panel flaps cannot be connected together to close the package. Even if the tab is only partially torn or the outer flap is weakened by tearing in other areas, the flaps cannot normally be securely held in place after opening.

Another complaint against the conventional package has to do with pouring the contents. Pouring takes place over an end edge of the top opening and over the adjacent opened end glue flap. This relatively wide area makes it difficult to control the flow of the particles, sometimes resulting in the particles spilling out over the outer sides of the glue flaps.

When packaging heavier particulate material the carton can be too heavy to conveniently be lifted by grasping the sides of the carton. It would be preferable in these cases to carry the package by a handle instead. Moreover, if it is desired to have a wider carton for better stability and handleability or to more conveniently package greater quantities of material in a carton, a handle becomes necessary. Introduction of a handle, however, limits the ability to provide a pouring opening in the top panel.

It would be desirable to have a carton with an improved reclosable pouring arrangement capable of concentrating the flow of particles poured from the carton.

BRIEF SUMMARY OF THE INVENTION

The invention is embodied in a carton comprised of side panels, end panels, a top panel and a bottom panel. A closure flap movable from closed position to open position is provided in a corner portion of the top panel and includes a flange comprised of upper portions of adjacent side and end panels. The carton further includes corner edges over which material packaged in the carton can be poured after the closure flap has been opened and means for maintaining the closure flap in closed position until disabled.

In a preferred embodiment, the means for maintaining the closure flap in closed position until disabled comprises tear lines connecting the closure flap flange to portions of the adjacent side and end panels. Removal of a tear strip in the side and end panels directly beneath the flange provides access to the flange when initially opening the closure flap. Fold lines in the top panel permit the closure flap to pivot up when moved from closed to open position.

The corner pouring edges are the upper edges of inserts or flaps positioned directly inside the portions of the side and end panels forming the flange of the closure flap. A handle in the top panel facilitates lifting and tilting the carton for pouring.

The carton can be readily opened without destroying or damaging its pouring and reclosing features and can be economically formed from a blank of generally rectangular shape.

These and other features and aspects of the invention, as well as its various benefits, will be made more clear in the subsequent detailed description of the preferred embodiment.

DETAILED DESCRIPTION OF THE PREFERRED EMBODIMENTS

Figure 1:
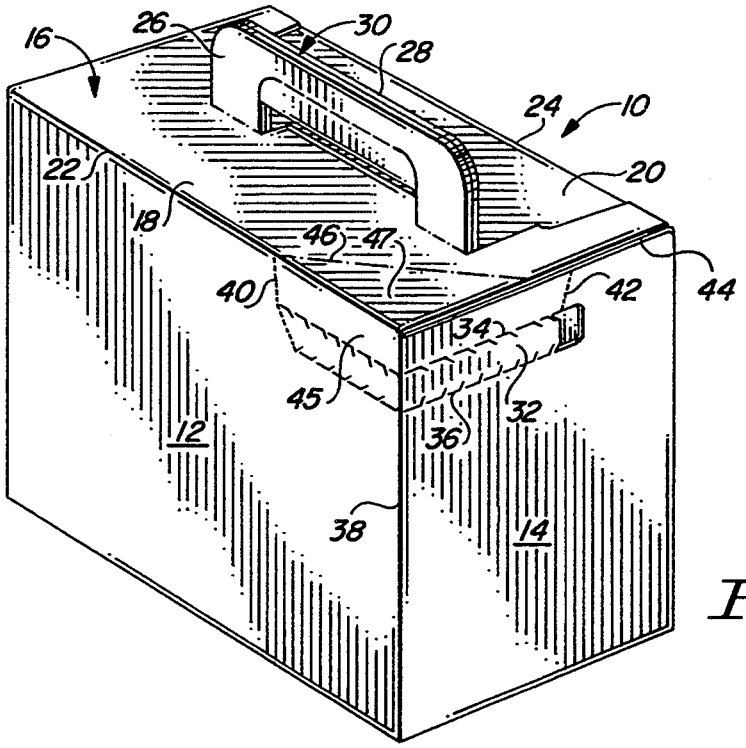
FIG. 1 is a pictorial view of a carton embodying the features of the invention.

Referring to FIG. 1, the carton 10 is comprised of side panels 12 connected to end panels 14, a top panel 16 and a bottom panel, not visible in this view. Overlapping flaps 18 and 20, which are connected to their associated side panels by fold lines 22 and 24, form the top panel, and aligned handle sections 26 and 28, which extend up from the top panel flaps 18 and 20, form a handle 30. A tear strip 32, defined along its major length by spaced parallel tear lines 34 and 36, extends from a point in the side panel 12 to a point in the end panel 14, bridging the fold line or corner 38 between the adjacent panels. Tear line 40 in side panel 12 extends up from the end of the tear strip 32 to the fold line 22, and in like manner tear line 42 in end panel 14 extends up from the tear strip to the fold line 44. A diagonal score line 46 in the top panel flap 18 extends from a point adjacent the end of the tear line 40 to a point adjacent the end of the tear line 42. The area between the tear lines 34, 40 and 42 and the top panel comprises a right-angled flange 45, and the portion of the top panel between the flange 45 and the score line 46 comprises a closure flap 47. The function of the tear lines, score line, flange and closure flap will be made clear below.

Figures 2, 8:
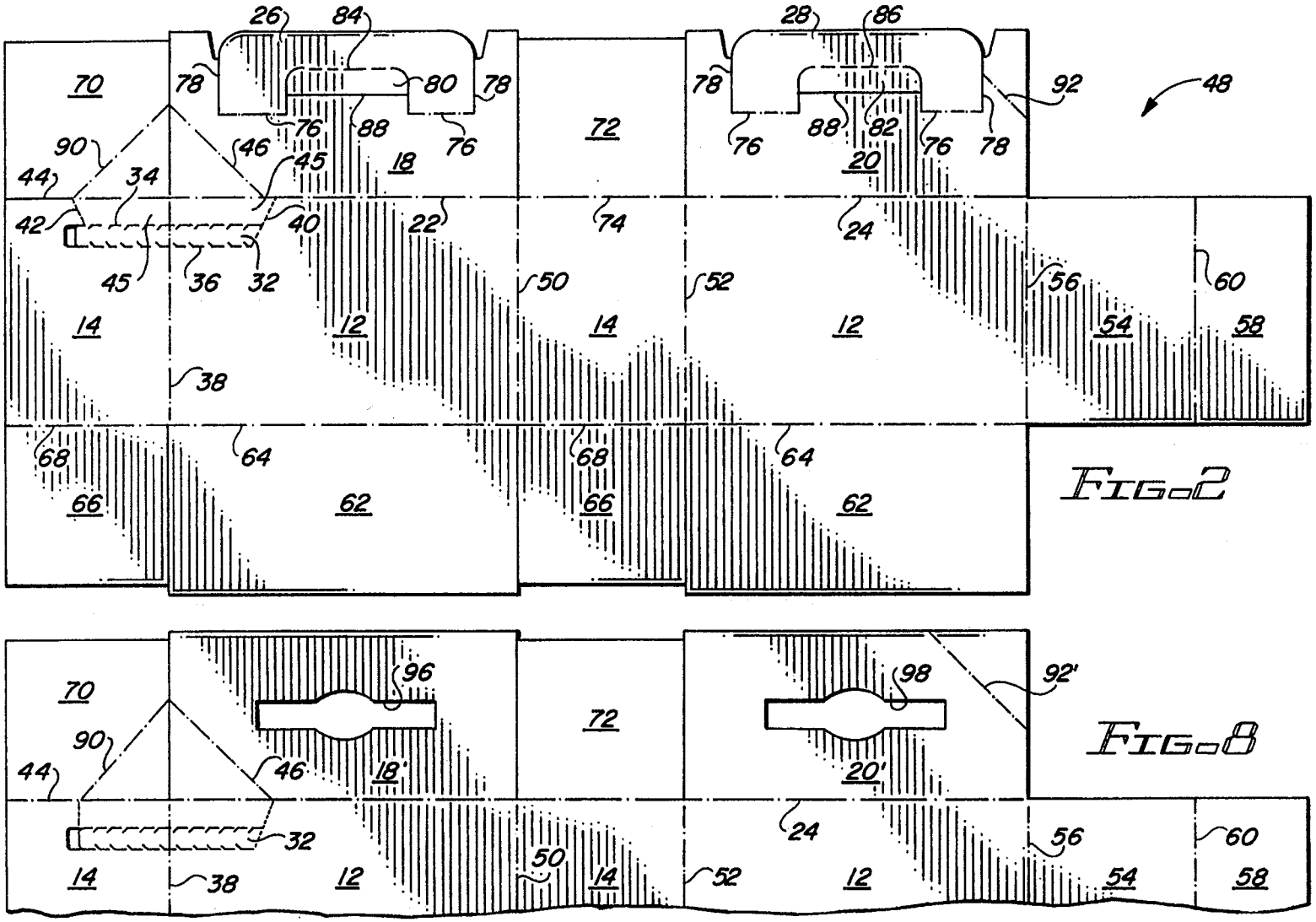
FIG. 2 is a plan view of a blank for forming the carton of FIG. 1.
FIG. 8 is a partial plan view of a carton blank with a modified top panel flap design.

A blank for forming the carton is shown in FIG. 2, wherein like reference numerals to those used in FIG. 1 refer to similar elements. The blank 48 is substantially rectangular in shape and comprised of a suitably strong, flexible material such as paperboard of the type conventionally employed in the carton and carrier industry. The end panel section 14 containing the tear strip is at the end of the blank and the side panel section 12 containing the tear strip is adjacent to it, connected by the fold line 38. The other end panel section 14 is connected along fold line 50 to the same side panel section 12 and along fold line 52 to the other side panel section 12. A first insert flap 54 is connected to the latter side panel section 12 along fold line 56 and to a second insert flap 58 along fold line 60. The function of the insert flaps will be explained in more detail below.

Bottom panel flaps 62 are connected to the side panel sections 12 by fold lines 64, and bottom panel glue flaps 66 are connected to the end panel sections 14 and 54 along fold lines 68. A top panel glue flap 70 is connected to the end panel section 14 containing the tear strip by the fold line 44, and another top panel glue flap 72 is connected to the other end panel section 14 by fold line 74. As also shown in FIG. 1, the top panel flaps 18 and 22 are connected to the side panel sections 12 along fold lines 22 and 24, respectively. The handle sections 26 and 28 are connected to their top panel flaps 18 and 20 by fold lines 76, and are separated from the top panel flaps by slits 78. Handle tabs or flaps 80 and 82 are connected to the handle sections 26 and 28 along fold lines 84 and 86, and are separated from the top panel flaps by slits 88. In addition, top panel glue flap 70 includes a fold line 90 extending from a point adjacent the end of tear line 42 to a point adjacent the end of score line 46, and top panel flap 20 includes a fold line 92 extending diagonally from a point adjacent the handle section 28 to a point at the end edge of the blank intermediate the width of the top panel flap 20.

To form a carton from the blank 48, assuming that the side of the blank facing the viewer is the interior surface of the blank, the blank is folded in about fold lines 52 and 38, causing the insert flap 54 to overlie the remote end panel section 14 and the insert flap 58 to overlie a portion of the adjacent side panel section 12. The insert flaps 54 and 58 are adhered to the end panel section 14 and the side panel section 12, respectively, in the stippled areas of the latter panel sections. Note that the insert flaps are not adhered to the tear strip 32 or to the flange 45. It will be understood that although the glue has been shown as being applied to the end and side panel sections, it can instead be applied to the insert flaps 54 and 58 in a similar pattern so as to contact the blank in areas corresponding to the stippled portions.

Figure 3:
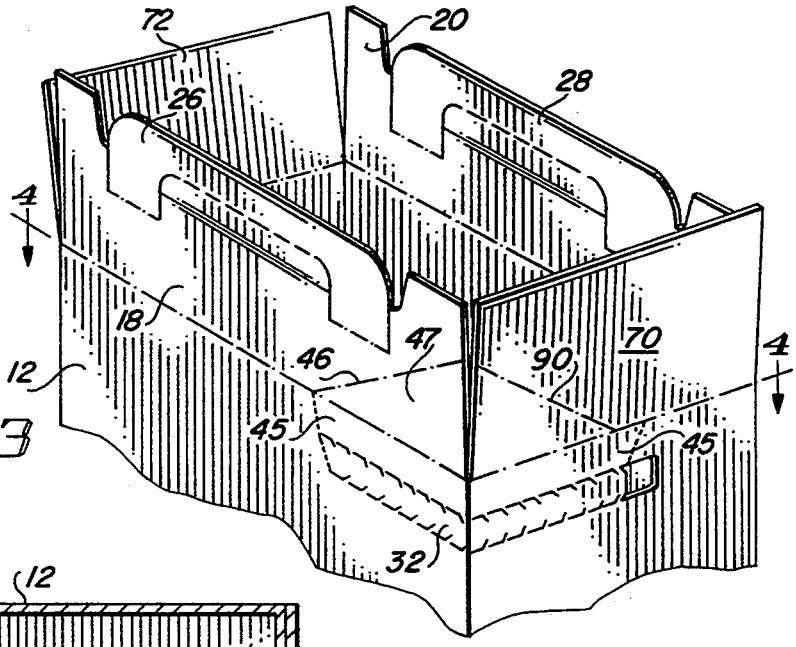
FIG. 3 is a partial pictorial view of the carton at an interim stage of fabrication.
Figure 4:
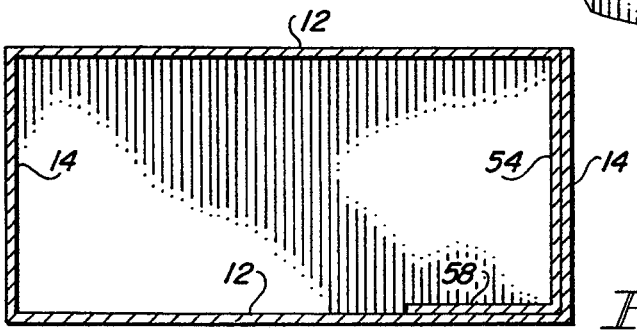
FIG. 4 is a transverse sectional view taken along line 4—4 of FIG. 3.

The folding and gluing steps result in formation of a collapsed sleeve. The sleeve is then squared up and the bottom panel is formed in conventional manner by folding the bottom glue flaps 66 in, folding and adhering one of the bottom panel flaps 62 to the glue flaps and folding and adhering the other bottom panel flap to the first bottom panel flap. The resulting open-top carton is illustrated in FIG. 3, which shows the top panel flaps 18 and 20 and the top panel glue flaps 70 and 72 extending upwardly as substantial extensions of the side and end panels of the carton. The carton is filled with the flaps in the position shown or folded back even farther so as not to interfere with the filling process. As illustrated in FIG. 4, the insert flap 58 is in face-to-face contact with an end portion of the side panel 12 and the insert flap 54 is in similar contact with the adjacent end panel 14.

Figure 5:
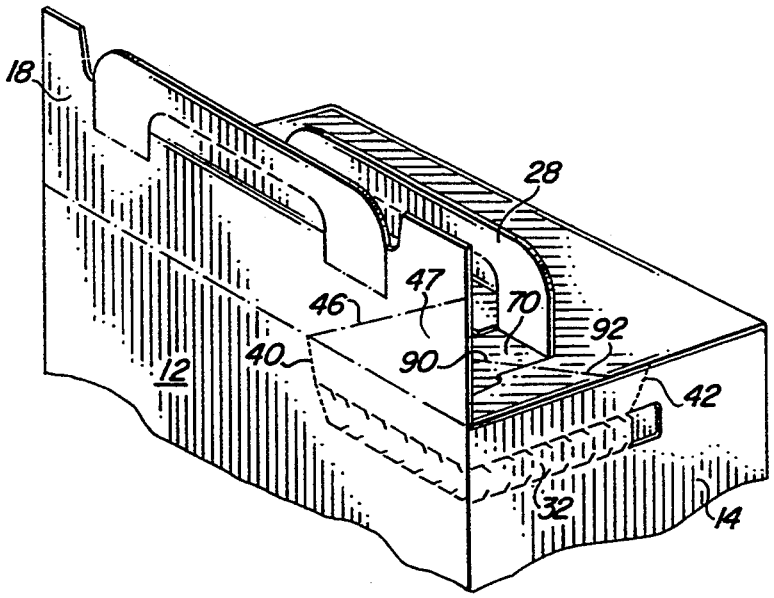
FIG. 5 is a partial pictorial view of the carton at a subsequent interim stage of fabrication.

After the carton has been filled the glue flaps 70 and 72 are folded down into horizontal position, glue is applied to the top panel flap 20 and the top panel flap is folded down and adhered to the glue flaps. Glue is also applied to the top panel flap 18, after which it is folded down and adhered to the glue flaps and to the underlying portions of the top panel flap 20. During these maneuvers edge 88 of the central portion of the top panel flap 20 moves under the edge 88 of the top panel flap 18 and the end portions of the top panel flap 18 overlie the end portions of the top panel flap 20. The handle sections 26 and 28 are folded to their upright position and brought together to form the two-ply handle shown in FIG. 1. As can be seen from FIGS. 3 and 5, the fold line 90 of the top panel glue flap 70, the fold line 92 of the top panel flap 20 and the score line 46 of the top panel flap 18 are in substantial alignment.

Figure 6:
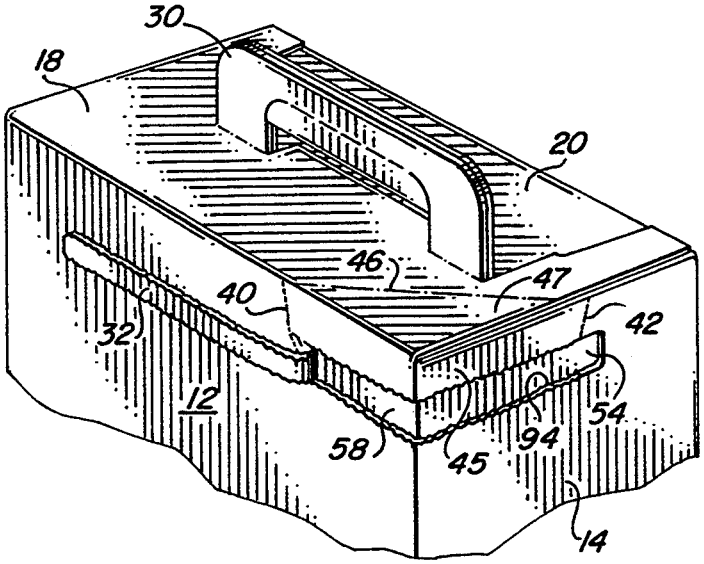
FIG. 6 is a partial pictorial view of the carton during removal of the tear strip.
Figure 7:
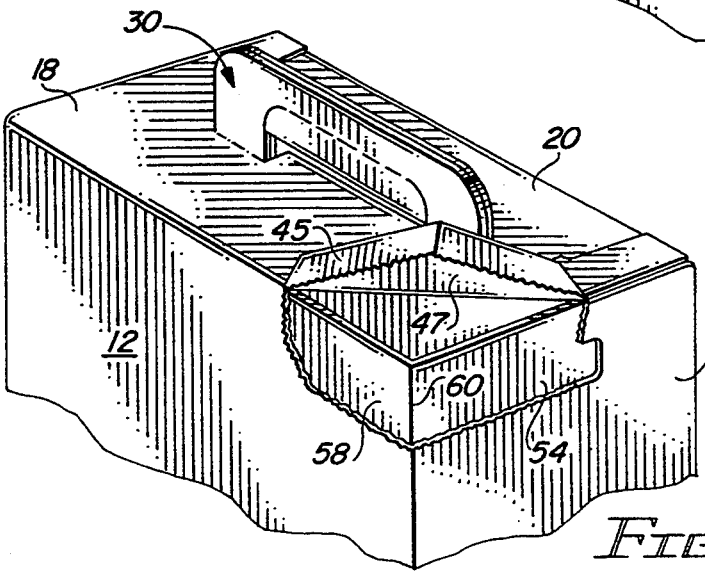
FIG. 7 is a partial pictorial view of the carton similar to that of FIG. 6, but after the corner closure flap has been folded up for pouring.

To open the carton the tear strip 40 is removed, as illustrated in FIG. 6, to create the opening 94 in the end panel 14 and side panel 12. The tear strip may be designed to be readily grasped, as by providing the end with a break-away tip, or by any other conventional expedient. Removal of the tear strip is readily accomplished since it will be recalled that the tear strip itself is not glued to the underlying insert flaps 54 and 58. The opening process is completed by pivoting the closure flap 47 up about the aligned fold lines 90, 92 and 46, to the position shown in FIG. 7. This can be most conveniently accomplished by pushing up against the corner of the flange 45 with enough force to sever the short tear lines 40 and 42. This is a simple step since, like the tear strip 32, the flange 45 is not adhered to the insert flaps 54 and 58. The closure flap 47 thus consists of the corner portion of the top panel flap 18, the underlying outer portion of the top panel flap 20 and the underlying corner portion of the top panel glue flap 70. The carton can now be tilted and the contents poured out over the corner formed by the adjoining insert flaps 54 and 58, which thus functions as a pouring spout. Lifting and tilting of the carton is made easy by the upstanding handle.

Although a particular type of top panel configuration and associated handle arrangement has been shown for purpose of illustration, it should be understood that the invention is not limited to such structure. For example, as shown in FIG. 8, the top panel flaps 18' and 20' may be of simpler design, not broken up by inclusion of a handle section but consisting simply of full panel sections containing central handle cutouts 96 and 98. When forming the top panel of a carton of this type, the two top panel flaps overlap, as in the formation of the bottom panel. The handle cutouts are aligned, permitting a separate handle strap to be adhered to the underlying top panel flap so as to extend up through the cutouts. In such an arrangement, the fold line 92' in the top panel flap 20' is of full length, since the top panel flap is not broken up by a handle section, and underlies the full length of the fold line 90 in a carton formed from the blank.

Regardless of the top panel and handle design, the corner opening and spout arrangement remain the same, with tear strips in the side and end panels and fold lines in the top panel allowing a corner portion of the top panel to be folded up to provide an opening through which the contents of the carton can be poured. Provision of the insert flaps provides a corner pouring edge which guides and controls the flow of the contents in a manner superior to the pouring edge of cartons in which the entire upper edge of one of the end panels functions as the pouring edge.

To reclose the lid or closure flap, it merely has to be pushed down again to its original position. Since the insert flaps maintain the integrity of the corner formation of the carton, the original tight fit of the closure flap flange 45 is again obtained, which tightly maintains the flap in closed position.

The carton is economical to produce, being formed from a single blank of generally rectangular shape by means of a few simple folding and gluing steps which can be carried out by hand or in a packaging machine. It can be carried easily by the upstanding handle, and can be stored or shipped in stacked layers made possible by the ability of the handle to be moved out of the way, as by being folded down or depressed into its recess, depending on the particular top panel and handle design employed. Further, the ability to reclose the carton to a secure, tight condition is very beneficial.

It should be apparent that the invention is not necessarily limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A carton for packaging pourable material, comprising:

side panels connected to end panels, a top panel and a bottom panel;

a closure flap in a corner portion of the top panel, the closure flap being connected to the top panel by a fold line about which the closure flap pivots when moved from closed to open position, the fold line extending diagonally across the corner portion of the top panel between adjacent side and end panels;

the closure flap including a flange comprised of upper portions of said adjacent side and end panels;

the carton including corner edges over which material packaged in the carton can be poured after the closure flap has been moved from closed to open position;

said corner edges being comprised of upper edges of two inner panel layers, one of the inner panel layers being in face-to-face relationship with a portion of the side panel forming part of the flange of the closure flap and the other inner panel layer being in face-to-face relationship with a portion of the end panel forming part of the closure flap, said inner panel layers being nonadhered to said portions of the side and end panels but being adhered to lower portions of the side and end panels, said other inner panel layer being foldably connected to the side panel opposite the side panel containing part of the closure flap and said one inner panel layer being foldably connected to said other inner panel layer;

tear lines connecting the flange to portions of the adjacent side and end panels, the tear lines maintaining the closure flap in closed position until severed; and the flange fitting tightly over said inner panel layers when reclosed after being opened.

2. A carton as defined in claim 1, including a tear strip in the side and end panels beneath the flange, the flange having a lower edge coinciding with an upper edge of the tear strip.

* * * * *